US005333422A

United States Patent [19]

Warren et al.

[11] Patent Number: 5,333,422

[45] Date of Patent: Aug. 2, 1994

[54] LIGHTWEIGHT EXTENDABLE AND RETRACTABLE POLE

[75] Inventors: John L. Warren; James E. Brandt, both of Santa Barbara, Calif.

[73] Assignee: The United States of America as represented by the United States Department of Energy, Washington, D.C.

[21] Appl. No.: 984,598

[22] Filed: Dec. 2, 1992

[51] Int. Cl.[5] ..... B66F 11/04

[52] U.S. Cl. ..... 52/115; 52/118

[58] Field of Search ..... 52/115, 118, 632, 113; 212/230, 264, 267, 268

[56] References Cited

U.S. PATENT DOCUMENTS

| | | | |
|---|---|---|---|
| 3,196,991 | 7/1965 | Johnson et al. | 52/115 |
| 3,359,559 | 12/1967 | Guinn | 52/113 X |
| 3,722,154 | 3/1973 | Sakamoto et al. | 52/115 X |
| 3,738,075 | 6/1973 | Nansel | 52/115 |
| 3,770,138 | 11/1973 | Chalupsky et al. | 52/115 X |
| 3,792,555 | 2/1974 | Sung | 52/118 X |
| 3,958,376 | 5/1976 | Campbell | 52/115 |
| 3,967,757 | 1/1967 | Goodman | 52/111 |
| 4,137,535 | 1/1979 | Rupprecht | 343/902 |
| 4,406,097 | 9/1983 | Meston | 52/115 X |
| 4,413,451 | 11/1983 | Featherstone et al. | 52/118 X |
| 4,468,904 | 9/1984 | O'Malley | 52/113 X |
| 4,594,824 | 6/1986 | Ziegler et al. | 52/115 X |
| 4,932,176 | 6/1990 | Roberts et al. | 52/113 |

*Primary Examiner*—Peter M. Cuomo

*Assistant Examiner*—Jerry Redman

*Attorney, Agent, or Firm*—Miquel A. Valdes; Roger S. Gaither; William R. Moser

[57] ABSTRACT

A lightweight extendable and retractable telescopic pole is disclosed comprising a plurality of non-metallic telescoping cylinders with sliding and sealing surfaces between the cylinders, a first plug member on the upper end of the smallest cylinder, and a second plug member on the lower end of the largest cylinder, whereby fluid pressure admitted to the largest cylinder will cause the telescoping cylinders to slide relative to one another causing the pole to extend. An elastomeric member connects the first plug member with one of the intermediate cylinders to urge the cylinders back into a collapsed position when the fluid pressure in the cylinders is vented. Annular elastomer members are provided which seal one cylinder to another when the pole is fully extended and further serve to provide a cushion to prevent damage to the cylinders when the pole is urged back into its retractable position by the elastomeric members and the venting of the pressure. A value mechanism associated with the pole is provided to admit a fluid under pressure to the interior of the telescoping cylinders of the pole while pressurizing a pressure relief port having an opening larger than the inlet port in a closed position whereby removal of the pressure on the relief port will cause the relief port to open to quickly lower the pressure in the interior of the telescoping cylinders to thereby assist in the rapid retraction of the extended pole.

20 Claims, 7 Drawing Sheets

LIGHTWEIGHT EXTENDABLE AND RETRACTABLE POLE

The invention described herein arose in the course of, or under, Contract No. DE-AC08-88NV10617 between the United States Department of Energy and EG&G Energy Measurements, Incorporated.

BACKGROUND OF THE INVENTION

This invention relates to a lightweight non-metallic extendable and retractable telescoping pole.

Retractable poles and masts have been fabricated mostly from aluminum, with a few devices made of fiberglass. Such prior designs typically weigh several hundred pounds and may use complicated networks of cranks or screws, lines or cables, and pulleys to extend or collapse the poles, resulting in a time-consuming operation each time the apparatus is to be extended or retracted.

For example, Goodman U.S. Pat. No. 3,296,757 discloses a telescoping mast apparatus wherein the mast is raised and lowered using a lead screw associated with a cranking mechanism. When the mast is first raised, the lead screw is detachably fastened first to the upper end of the topmost mast member. A crank and a set of bevel gears then raises the lead screw to thus raise and lower the topmost antenna mast member. When this portion has been raised, a pin is placed through an aperture in the bottom of this member and a corresponding aperture in the top of the next mast member. The lead screw is then detached from the topmost mast member and attached to the next mast member which is then raised in like manner by the crank and bevel gears. This process must be repeated to lift each mast member or section; and the process is then repeated in reverse to lower the antenna mast.

Roberts et al. U.S. Pat. No. 4,932,176 describes a telescoping mast system using wire ropes and pulleys mounted near or within tube collars so that the ropes and pulleys are totally enclosed within the mast system. The wire ropes are attached to a winch so that when the winch is rotated in one direction the ropes axially move the inner tubes from a nested or stowed position to a fully vertically extended position. When the winch is rotated in the opposite direction, the ropes apply a positive retracting force to the inner tubes to return them to a nested position.

It has also been proposed to use pneumatic pressure to extend an antenna mast formed of telescoping light metal sections. Rupprecht U.S. Pat. No. 4,137,535 discloses such a telescoping antenna mast wherein each section, except the bottom section, is provided with a piston attached to its lower end which fits into the next larger cylindrical section below the piston. Each piston has a passage for a gas to flow under pressure to the next section, commencing at the base or lowest section. The top section is closed at its upper end. The antenna mast is retracted by venting the bottom section whereby gas from the upper sections flow back through the passages in the respective pistons to thereby permit the mast to retract in a damped manner by its own weight.

However, while such a dampening mechanism may protect such a device from damage during retraction of the pole, it necessarily must not only reduce the speed of retraction, but the speed of extension as well. Furthermore, retraction of such a pole by its own weight obviously necessitates the use of a pole with sufficient mass to accomplish such retraction in an efficient manner. Therefore, there remains a need for a lightweight extendable and retractable pole which, while lightweight, may be both quickly extended and retracted.

SUMMARY OF THE INVENTION

It is, therefore, an object of the invention to provide a lightweight extendable and retractable telescopic pole comprising a plurality of non-metallic telescoping cylinders with sliding and sealing surfaces between the cylinders, a first plug member on the upper end of the smallest cylinder, and a second plug member on the lower end of the largest cylinder, whereby fluid pressure admitted to the largest cylinder will cause the telescoping cylinders to slide relative to one another causing the pole to extend; and an elastomeric means, connecting the first plug member with an intermediate cylinder, urges the cylinders back into a collapsed position when the fluid pressure in the cylinders is vented.

It is another object of the invention to provide a lightweight extendable and retractable telescopic pole such as described above wherein annular elastomer means are provided which seal one cylinder to another when the pole is fully extended and which further serve to provide a cushioned stop to prevent damage to the cylinders when the pole is raised into its fully extended position.

It is another object of the invention to provide a lightweight extendable and retractable telescopic pole such as described above wherein valve means associated with the pole are provided to admit a fluid under pressure to the interior of the telescoping cylinders of the pole while pressurizing in a closed position a pressure relief port having an opening larger than the inlet port whereby lowering the inlet pressure will cause the relief port to open to quickly lower the pressure in the interior of the telescoping cylinders to thereby assist in the rapid retraction of the extended pole.

These and other objects of the invention will be apparent from the following description and accompanying drawings.

DETAILED DESCRIPTION OF THE INVENTION

Figure 1:
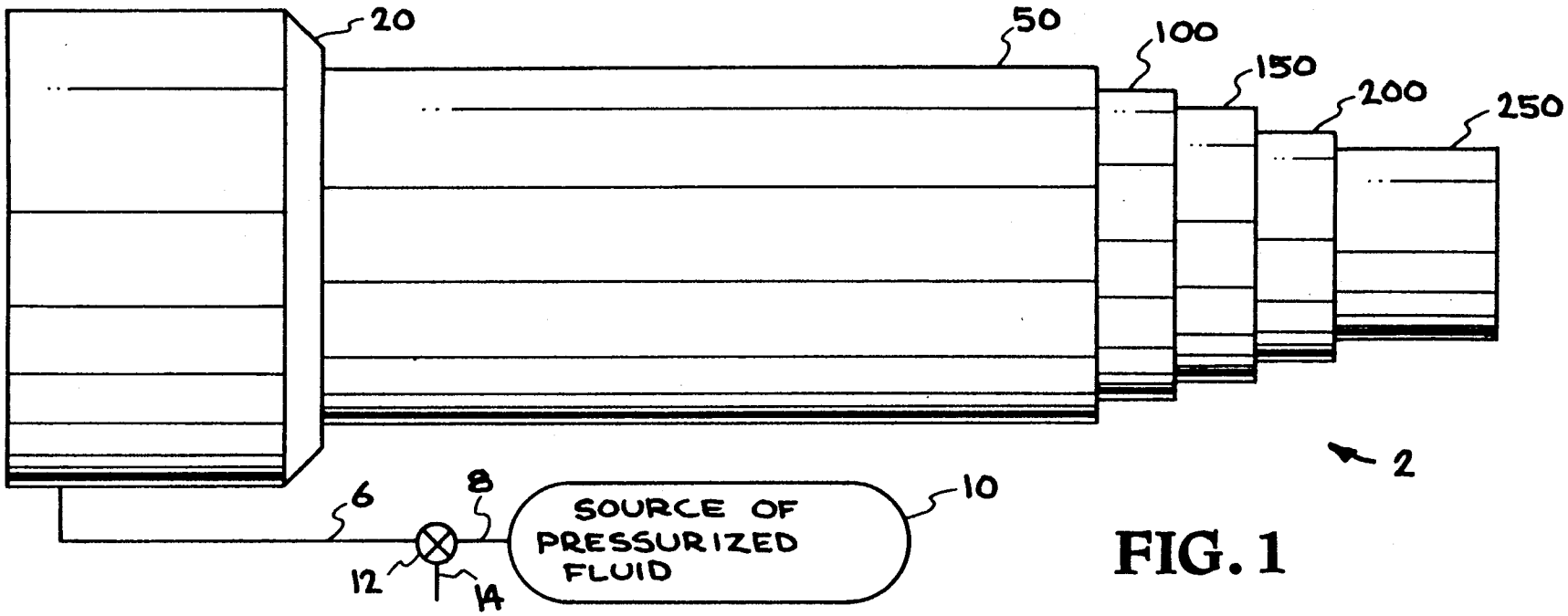
FIG. 1 is a vertical view of the telescoping pole of the invention in a retracted position.
Figure 2:
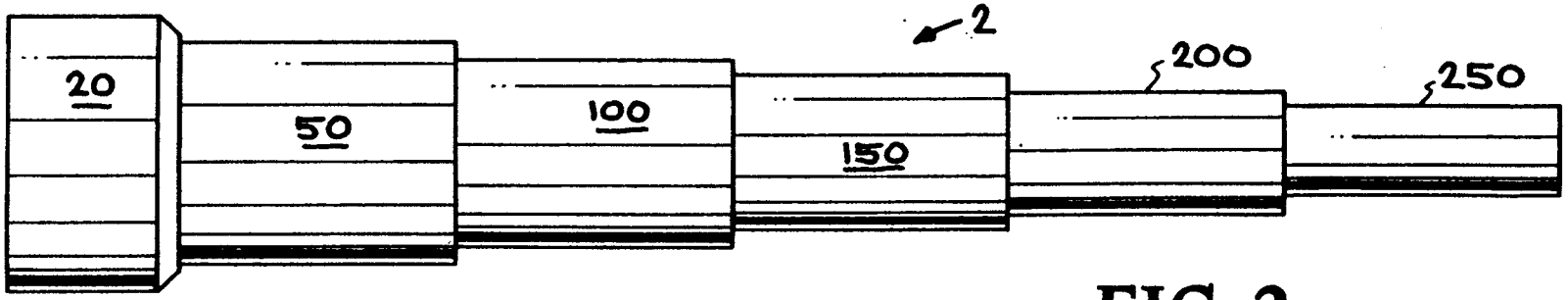
FIG. 2 is a vertical view of the telescoping pole of FIG. 1 shown in an extended position.

Referring now to FIGS. 1 and 2, the lightweight extendable and retractable telescoping pole apparatus of the invention is generally shown at 2 comprising a base 20, a first outer cylinder 50, a second cylinder 100 nested or telescoped within cylinder 50, a third cylinder 150 nested within cylinder 100, a fourth cylinder 200 nested within cylinder 150, and a fifth and innermost cylinder 250 nested within cylinder 200.

A pressurized source of fluid 10 is also shown connected to pole apparatus 2 to provide the pressure source used for rapid extension of pole apparatus 2. Fluid pressure source 10 may, for example, comprise a pressurized air tank having a pressure ranging from about 100 to about 200 psi, preferably about 140 psi. In its simplest form, fluid pressure from source 10 is supplied to telescoping pole 2 via lines 6 and 8 and valve 12. Valve 12 may comprise a 3 way valve with a vent at 14 to permit the fluid to be exhausted from pole apparatus 2 when it is desired to retract pole apparatus 2. A preferred valve mechanism which permits both rapid pressurization through a first passageway for extension of the pole apparatus, as well as rapid evacuation of the pressurized fluid through a much larger evacuation port for rapid retraction of the pole apparatus, will be described below.

Cylinder 50, as well as cylinders 100, 150, 200, and 250, each comprises a graphite filament-wound epoxy tube made using carbon fibers having a tensile modulus of from about $33 \times 10^6$ psi to about $50 \times 10^6$ psi. Cylinders 50, 100, 150, 200, and 250 must be capable of withstanding internal pressures as high as 200 psi and preferably have a tube wall thickness of approximately 0.1 inch (to maintain the desired lightweight characteristic of pole apparatus 2).

Each of the cylinders should have smooth inner and outer surfaces of 30 RMS or better, although as will be apparent from the description below, it is not necessary that the inner surface of smallest cylinder 250 or the outer surface of largest cylinder 50 be provided with such smoothness since such surfaces do not engage mating surfaces on adjoining cylinders.

Since it very important to the proper operation of pole apparatus 2 that the cylinders telescope within one another smoothly and without binding or encountering other sliding restrictions, the cylinders, in addition to possessing the recited surface smoothness, must also exhibit a high degree of trueness. For a cylinder having a 12 foot length neither the OD or ID of the cylinder should vary more than from about 0.001 to about 0.003 inches from the center axis of the cylinder. Preferably, neither the OD or ID of any of the cylinders should vary more than about 0.002 inches from the center axis of the cylinder over a 12 foot length. If the cylinder length varies from 12 feet in length, the specified trueness of the cylinder may be adjusted proportionately.

Graphite filament-wound epoxy cylinders or tubes having such properties are commercially available from Advanced Composite Products & Technology, Inc. of Huntington Beach, Calif.

Figure 3:
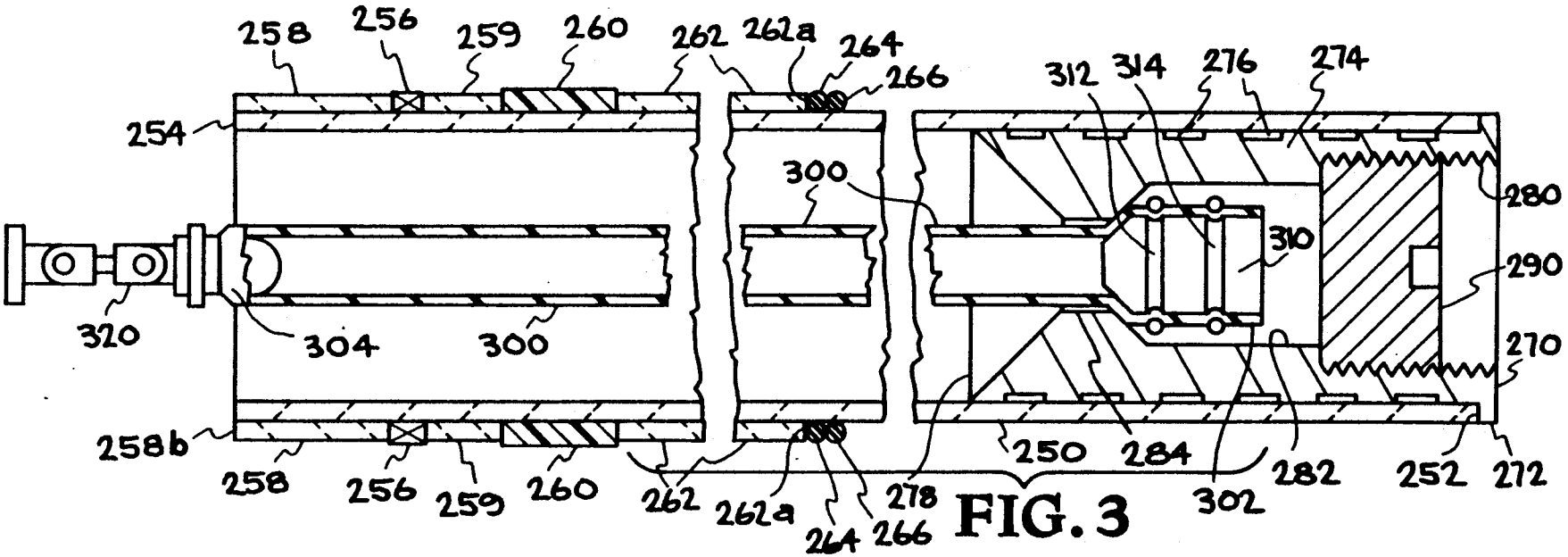
FIG. 3 is a fragmentary vertical cross-sectional view of the smallest and uppermost telescoping cylinder showing the seals, spacers, bearing surfaces, and stop means provided adjacent the ends of the cylinder, as well as the interior end plug which seals off the upper end of the cylinder.

Turning now to FIG. 3, there is illustrated a cross-section of the uppermost and smallest cylinder 250 of the nested cylinders shown in FIGS. 1 and 2. As mentioned above, cylinder 250 (as well as the other cylinders) is preferably about 12 foot in length to permit an overall extension of the illustrated five section pole apparatus 2 to about 57 feet. In a preferred embodiment, cylinder 250 has an OD of about 1.5 inches to provide the requisite strength needed for applications such as a mast antenna, remote camera mast, extension ladder for fire-rescue work, etc. Larger diameters could, of course, be employed, for cylinder 250, but it will be understood that this would result in the need for enlargement of all of the telescoping cylinders and the use of such larger diameters (for all of the cylinders) will be at the expense of the lightweight characteristics of the pole apparatus of the invention. However, it would allow for the construction of much longer poles, which would still be much lighter and compact than any previous type pole.

Cylinder 250 is provided, adjacent its upper end 252, with an end cap 270 having a shoulder or lip portion 272 with an OD approximately the same as the OD of cylinder 250. The main body portion 274 of end cap 270 has an OD approximately that of the ID of cylinder 250 so that it will snugly fit inside cylinder 250. Main body portion 274 of end cap 270 is provided with a series of annular grooves 276 around its outer surface which are filled with epoxy cement to facilitate the bonding of end cap 270 to the inner surface of cylinder 250.

End cap 270 is further provided with a central threaded bore 280 extending downwardly from lip 272 and terminating in a smooth bore 282 of somewhat reduced diameter and which is concentric with a smaller counterbore 284 which extends upwardly from lower surface 278 to intersect smooth bore 282. A threaded plug 290, received in threaded bore 280, seals the top portion of upper cylinder 250.

To assist in the rapid retraction of pole apparatus 2, after removal of the fluid pressure, upper end 252 of cylinder 250 is secured to one end of an elastomeric member 300 which stretches when the telescoping cylinders of pole apparatus 2 are extended, thereby providing tension on cylinder 250 to urge it to a downward or retracted position as will be further explained below. End 302 of elastomeric member 300 is passed through counterbore 284 into smooth bore 282 where a plug 310, having a diameter slightly larger than bore 282, is inserted into end 302 of member 300. Plug 310 is provided with two annular grooves 312 and 314. Clamping rings may be placed around member 302 adjacent annular grooves 312 and 314 which clamping rings, when tightened, will secure plug 310 in end 302 of member 300.

Elastomeric member 300 is secured, at its opposite end 304, to a swivel member 320, which, in turn, is secured to a plug member 192 in the lower end of cylinder 150, as will be described below with respect to FIGS. 9 and 11.

Cylinder 250 is provided with a seal ring 256 adjacent lower end 254 of cylinder 250, which will also engage the inner surface of nesting cylinder 200, as will be described below, to prevent or inhibit the escape of pressurized fluid from pole apparatus 2 via the interface between cylinders 250 and 200. Seal ring 256, which is shown in greater detail in FIG. 3A, comprises a polytetrafluoroethylene (PTFE) seal material 256*a* which is u-shaped in cross-section and contains a coil spring 256*b*. It is positioned around cylinder 250 with the open portion 256*c* of the u-shaped seal facing downward, i.e., toward the direction of retraction of cylinder 250 into cylinder 200, which comprises the pressure side of the seal, i.e., the pressure from within cylinder 250 encounters open portion 256*c* of u-shaped seal 256 first. Such a seal ring is commercially available from the Bal Seal Engineering Company, Inc. of Santa Ana, Calif.

To secure seal ring 256 in a non-slidable position on the outside surface of cylinder 250, adjacent lower end 254 thereof, spacer rings or cylinders 258 and 259 are bonded to the outer surface of cylinder 250 respectively just below and above seal 256 to thereby immobilize seal 256 on cylinder 250, i.e., to prevent seal 256 from sliding upward or downward. Spacer rings 258 and 259 may be constructed of the same material as cylinder 250, i.e., of a graphite fiber-reinforced epoxy material and may be bonded to the outer surface of cylinder 250 by an appropriate bonding material such as an epoxy bonding agent.

To facilitate a snug fit between spacer rings 258 and 259 on cylinder 250, the ID of spacer rings 258 and 259 may be made either identical or just slightly larger than the OD of cylinder 250, e.g., 0.001 inch or less larger, with respect to the OD of cylinder 250.

As shown in FIG. 3, the width of spacer ring 258 is selected, with respect to the desired position of seal ring 256 on cylinder 250, so that the lower end 258*b* of spacer 258 is flush with the lower end 254 of cylinder 250. This permits spacer 258 to also act as a stop for cylinder 250 when pole apparatus 2 is retracted, as will be described below. Preferably, seal ring 256 is positioned approximately 1 inch from lower end 254 of cylinder 250.

Positioned just above spacer ring 259 on the outer surface of cylinder 250 is a bearing ring or sleeve 260 which bears against the inner surface of cylinder 200, as will be described below. Bearing sleeve 260 is made of a polytetrafluoroethylene (PTFE) material impregnated with about 25 wt. % carbon. Such a bearing material is available under the trademark "Turcite" from the Shamban Company of Carson, Calif.

Positioned just above bearing 260 on the outer surface of cylinder 250 is another spacer ring 262 which may be constructed of the same material as spacers 258 and 259 and which may be dimensioned and secured to cylinder 250 in like manner as spacers 258 and 259. Spacer ring 262 cooperates with spacer 259 to immobilize bearing sleeve 260 on cylinder 250. Spacer ring 262 serves the dual function of immobilizing bearing sleeve 260 in place, as well as comprising a stop for cylinder 250 during the extension of pole apparatus 2.

Positioned around cylinder 250 adjacent the upper edge 262*a* of spacer/stop 262 are a pair of O-rings 264 and 266 which may comprise Buna-N rubber O-rings. As will be explained below, O-rings 264 and 266 serve the dual purpose of providing an additional seal between cylinders 250 and 200, when pole apparatus 2 is fully extended, as well as providing a cushion when edge 262*a* of spacer 262 functions as a stop for cylinder 250. Preferably, upper edge 262*a* of spacer 262 is located about 6 inches above bottom edge 254 of cylinder 250 to permit full extension of cylinder 250 with respect to cylinder 200 with which O-rings 264 and 266 will interact to limit the total extension of cylinder 250.

With respect to the thicknesses of spacers 258, 259, and 262, i.e., the OD of the spacers, it must first be noted that the thicknesses of the three spacers (which preferably are all identical in thickness) must be preselected to provide an OD slightly smaller than the ID of cylinder 200 so that cylinder 250, with spacers 258, 259, and 262 bonded to the outer surface thereof, will freely slide inside cylinder 200. The OD of the spacers should also be slightly less than the OD of bearing sleeve 260, which, in turn, will be slightly less than the ID of cylinder 200 so that bearing sleeve 260, not spacers 258, 259, and 262, will bear on the inner surface of cylinder 200. Of course, seal ring 256 has a more yieldable construction, as well as material, but it too will be appropriately sized, of course, to provide a good seal to the inner surface of cylinder 200. The diameter of O-rings 264 and 266 should also be selected to provide an OD approximately that of spacers 258, 259, and 262 so that O-rings 264 and 266 also do not interfere with the travel of cylinder 250 within cylinder 200. However, it should be noted that when cylinder 250 is fully extended, the forces exerted on O-rings 264 and 266, respectively by spacer 262 of cylinder 250 and spacer 222 of cylinder 200, will compress O-rings 264 and 266 slightly to provide an additional seal between cylinders 200 and 250.

Figure 4:
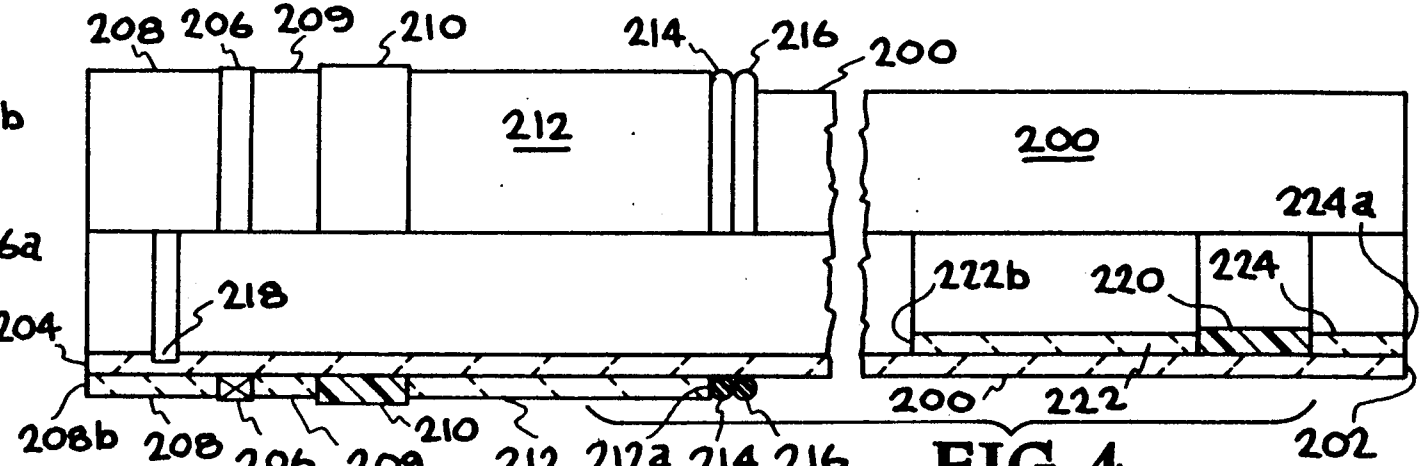
FIG. 4 is a fragmentary and partially cutaway vertical cross-sectional view of one of the intermediate telescoping cylinders showing the seals, spacers, bearing surfaces, and stop means provided adjacent both ends of the cylinder.

Turning now to FIG. 4, the structure of a typical intermediate cylinder, such as cylinders 100, 150, and 200, is shown. Therefore, while the cylinder illustrated in FIG. 4 is indicated to be cylinder 200, it will be understood that the associated parts to be described, except for diameters, will be identical to the same parts on intermediate cylinders 100 and 150.

Cylinder 200 is provided with an annular groove 218 on the inner surface of cylinder 200 adjacent bottom edge 204. Annular groove 218 receives a stainless steel retention ring (240 in FIG. 9) to retain a stop means for cylinder 250, as will be described below with respect to FIGS. 9 and 10.

Figure 3A:
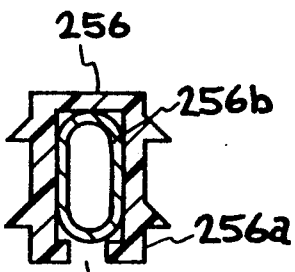
FIG. 3A is an enlarged cross-sectional view of one of the seals shown in FIG. 3.

Similar to the previously described structure for cylinder 250, the outer surface of lower end 204 of cylinder 200 is provided with a first graphite fiber-reinforced epoxy spacer 208, a seal ring 206 such as previously described with respect to FIG. 3A, a second graphite fiber-reinforced epoxy spacer 209, a Turcite bearing sleeve 210, a third graphite fiber-reinforced epoxy spacer 212, and O-rings 214 and 216 adjacent upper end 212*a* of spacer 212. These structural elements bonded or secured to the outer surface of cylinder 200 adjacent lower end 204 will interact with the inner surface of the next larger cylinder 150 just as previously described with respect to the structure on cylinder 250 interacting with the inner surface of cylinder 200.

However, unlike uppermost cylinder 250, cylinder 200 is provided with another set of spacers to immobilize another bearing sleeve located on the inner surface of cylinder 200, adjacent upper end 202 of cylinder 200. As shown in FIG. 4, an upper bearing sleeve 220 having an OD slightly less than the ID of cylinder 200 is placed near top end 202 of cylinder 200 and immobilized in this position by spacer rings or cylinders 222 and 224 which are respectively located below and above bearing sleeve 220 and are bonded to the inner surface of cylinder 200. Upper spacer 224 may be dimensioned and located such that its upper edge 224*a* is flush with upper end 202 of cylinder 200 for purposes of maximum utilization of tube length, as well as to inhibit egress of foreign matter into the space between cylinders 200 and 250 above bearing sleeve 220 and upper spacer 224. The width of spacers 222 and 224 and the width of bearing sleeve 220 are selected to position bottom edge 222*b* of spacer 222 at a position where edge 222*b* will function as a stop to limit the upper extent of the travel of cylinder 250 in cylinder 200, as will be described below.

Figure 5:
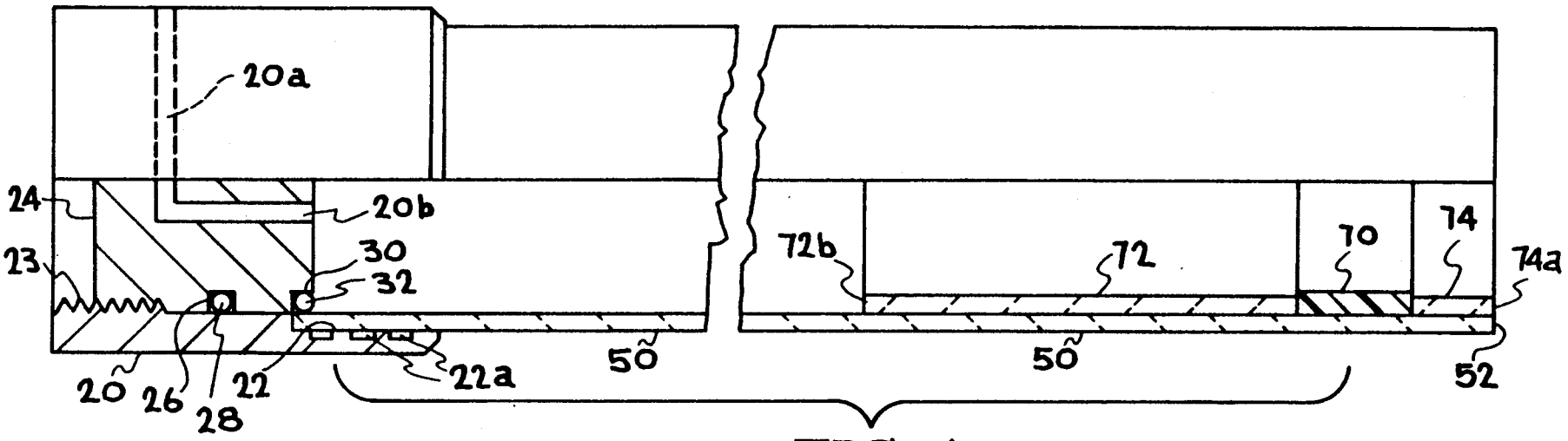
FIG. 5 is a fragmentary and partially cutaway vertical cross-sectional view of the largest of the cylinders which comprises the base member of the extendable and retractable pole, showing the seals, bearing surfaces, and stop means provided adjacent the ends of the cylinder, as well as the interior end plug which seals off the lower end of the base cylinder.

FIG. 5 illustrates the construction of the larger and lowermost cylinder in the telescoping stack of cylinders. Cylinder 50 is provided with an upper inner bearing sleeve 70 which engages the outer surface of nesting cylinder 100 as cylinder 100 extends or retracts relative to cylinder 50. As previously described with respect to upper inner bearing sleeve 220 on the inside of cylinder 200, bearing sleeve 70 is immobilized on the inner surface of cylinder 50 by spacers 72 and 74 with upper end 74*a* of upper spacer 74 preferably mounted flush with upper end 52 of sleeve 50 and lower edge 72*b* of lower spacer 72 also functioning as a stop for the upward travel of cylinder 100 during the extension of pole apparatus 2.

However, unlike any of the other cylinders, cylinder 50 does not slide, but is rather stationary and does not, therefore, require the lower outer bearing, spacers, seal, and stop apparatus which all of the other cylinders require. Instead, the lower outer surface of cylinder 50 is secured to the surface of a matching circular bore 22 in a base 20 by an adhesive such as an epoxy cement which may be provided in inner annular grooves 22*a* provided in bore 22 of base 20.

Base 20 may be further provided with a threaded bore 23 coaxial with bore 22 which receives a plug 24. An annular groove 26 in the non-threaded end of plug 24 carries an O-ring 28 which seals to bore 22 of base 20. Plug 24 and O-ring 28 act to seal the bottom of cylinder 50. In the embodiment shown in FIGS. 1 and 5, base 20 and plug 24 may be further respectively provided with passageways 20*a* and 20*b*, shown in dotted lines in FIG. 5, to permit ingress and egress of the pressurized fluid used to extend pole apparatus 2.

Plug 24 is further provided with a cutaway portion 30 at the upper outer edge of plug 24 which receives an O-ring 32 which protrudes above the upper surface of plug 24. Plug 24 further acts as a stop for the downward movement of inner cylinder 100, which stop is cushioned by contact of spacer member 108 on the outside of cylinder 100 with O-ring 32.

Figure 6:
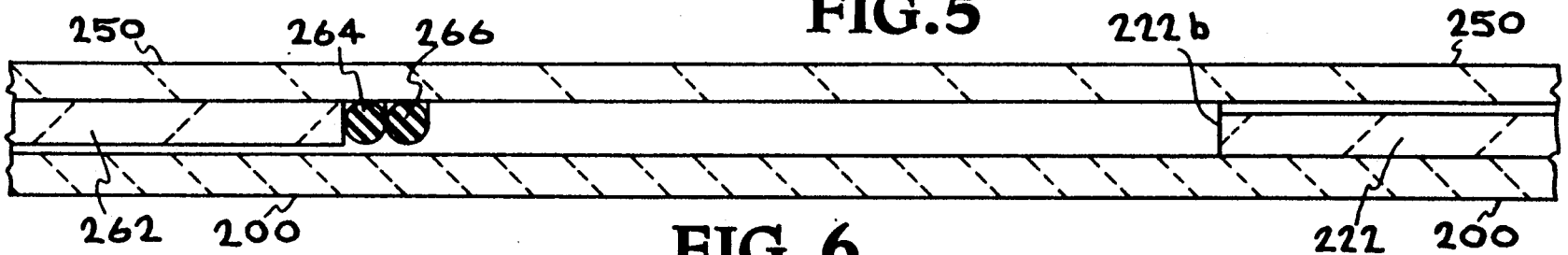
FIG. 6 is a fragmentary cross-sectional view of one wall of each of two of the telescoped cylinders prior to full extension of the pole.
Figure 7:
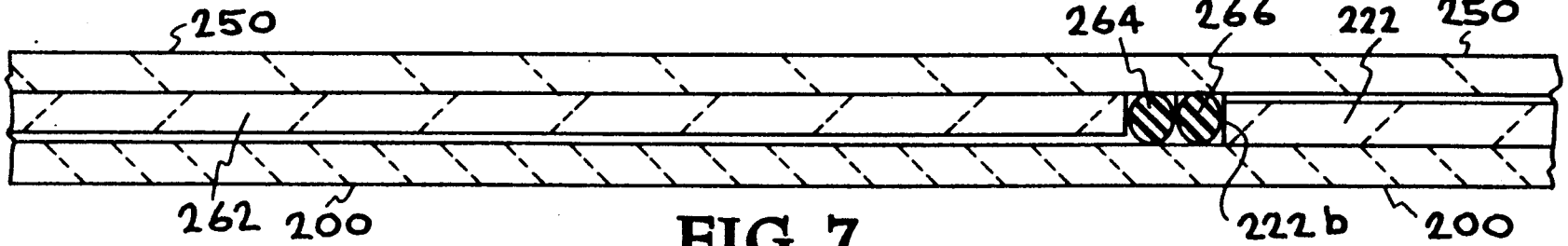
FIG. 7 is a fragmentary cross-sectional view showing the walls of the two telescoped cylinders of FIG. 6 after full extension of the pole, showing the two O-rings on the outer surface of the inner cylinder in contact with the stop on the inner surface of the outer cylinder.

Referring now to FIGS. 6 and 7, the upward travel of the cylinders and the function of the stop mechanism will be described with respect to cylinders 250 and 200. It will, of course, be appreciated that the following description, will equally apply to the interaction between cylinders 200/150, 150/100, and 100/50 during the extension of pole apparatus 2.

As shown in FIG. 6 (which, it will be appreciated, is not to scale, but rather reduced in length for illustrative purposes), cylinder 250 is in a lowered position with O-rings 264 and 266 thereon around cylinder 250 above spacer 262, but not in contact with stop end 222*b* of spacer 222 within cylinder 200. However, when fluid pressure is admitted to the volume within the cylinders, cylinder 250 is moved upwardly, along with spacer 262 and O-rings 264 and 266, as shown in FIG. 7, until O-rings 264 and 266 make contact with lower edge stop surface 222*b* on spacer 222, which then stops any further upward movement of cylinder 250, with respect to cylinder 200. Furthermore, the compressive forces respectively exerted by spacer 222 of cylinder 200 and spacer 262 of cylinder 250 against O-rings 264 and 266 cause O-rings 264 and 266 to distort into oval-shapes, causing O-rings 264 and 266 to form a further seal between cylinders 200 and 250.

Figure 8:
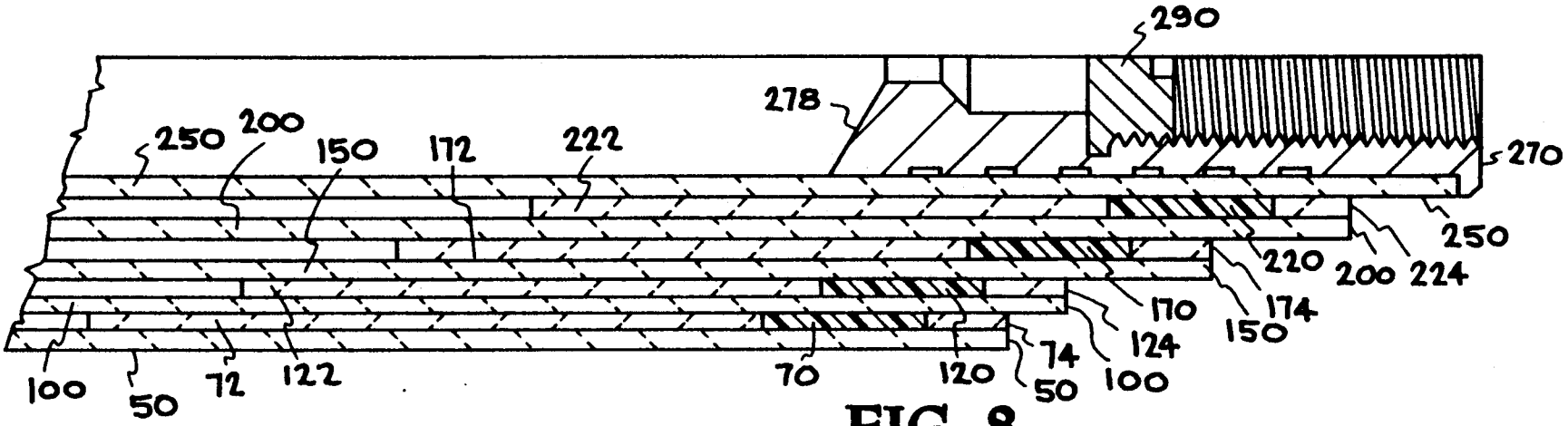
FIG. 8 is a fragmentary cross-sectional view of the upper portion of the telescoped stack of cylinders of the pole of the invention.
Figure 9:
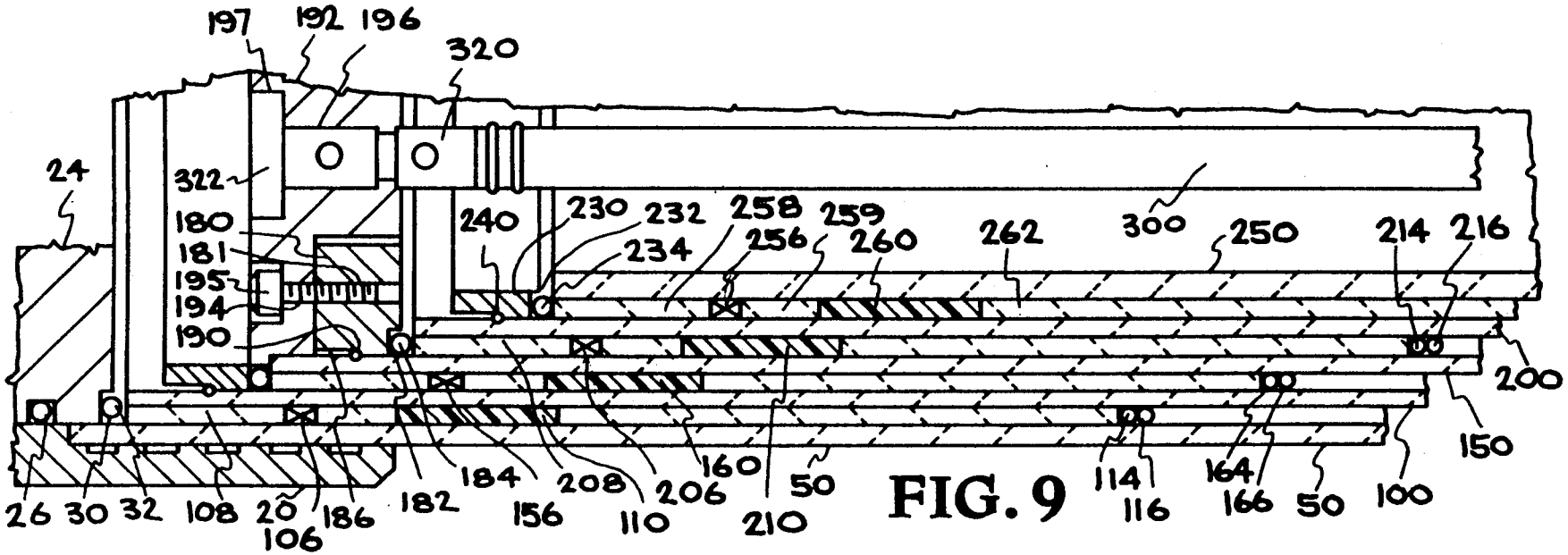
FIG. 9 is a fragmentary cross-sectional view of the lower portion of the telescoped stack of cylinders of the pole of the invention.

As will be readily seen from an examination of FIGS. 8 and 9, similar stops of the respective upward travel of cylinders 200, 150, and 100 will occur when O-rings 214/216, 164/166, and 114/116 on cylinders 200, 150, and 100 respectively contact stop surfaces 172*b*, 122*b*, and 72*b* on cylinders 150, 100, and 50 to similarly arrest the upward movement of cylinders 200, 150, and 100.

Figure 10:
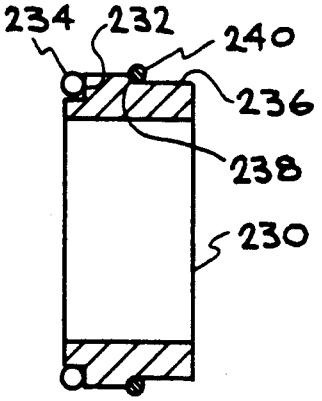
FIG. 10 is a cross-sectional view of one of the cylindrical sleeve stop members shown in FIG. 9.
Figure 11:
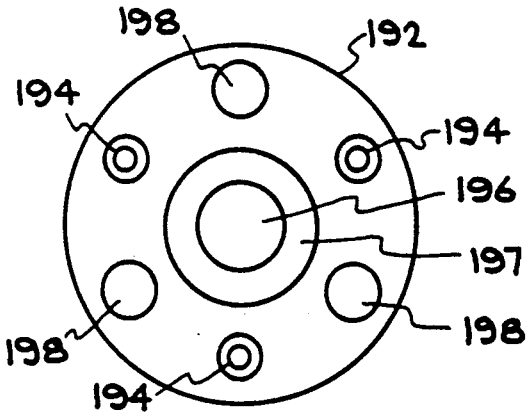
FIG. 11 is a top view of the plug member shown in FIG. 9 for retaining the lower end of the elastomeric member.

Turning now to FIGS. 9–11, the stop means provided at the bottom of cylinders 50, 100, 150, and 200 to respectively provide a cushioned stop for the downward travel of cylinders 100, 150, 200, and 250 will now be described.

As shown in both FIGS. 9 and 10, a cylindrical sleeve stop member 230 having an OD slightly smaller than the ID of cylinder 200 is received in the bottom of cylinder 200. Cylindrical sleeve stop member 230 is preferably formed of a plastic material, such as a polycarbonate. Sleeve 230 is provided with a first cutaway portion 232 at its upper outer edge to receive an O-ring 234 which is preferably secured to cutaway portion 232 by an appropriate adhesive such as an epoxy cement. O-ring 234 acts as a cushioned stop for the downward travel of cylinder 250 by coming into contact with the lower edge 258*b* of spacer 258 located on the outer surface of cylinder 250 at the bottom edge 254 of cylinder 250, as seen in both FIGS. 3 and 9.

To secure cylindrical sleeve stop member 230 within cylinder 200, sleeve member 230 is further provided with a second cutaway portion 236 on the outer surface of member 230, adjacent the lower portion of the sleeve, to provide a shoulder 238 between cutaway portion 236 and the outer edge of sleeve 230. When a retaining ring 240, preferably formed of a metal such as stainless steel, is received in the annular groove 218 previously described with respect to FIG. 4, ring 240 butts against shoulder 238 to prevent cylindrical sleeve stop member 230 from being driven out of the bottom of cylinder 200 by the force of spacer 258 on cylinder 250 contacting O-ring 234 as cylinder 250 retracts.

Cylindrical sleeve stop member 230 is assembled in cylinder 200 by initially sliding it into the bottom of cylinder 200 to a point where groove 218 is visible (which will necessitate sliding cylinder 250, already within cylinder 200, upward). Retaining ring 240 (which may be a spring tensioned split ring) is then inserted into groove 218 and sleeve member 230 is then moved downward toward end 204 of cylinder 200 until shoulder 238 of cutaway portion 236 contacts retaining ring 240. To then secure sleeve member 230 against upward movement in cylinder 200, the remaining space between sleeve member 230 and cylinder 200 defined by cutaway portion 236 may be filled with a silicone cement to thereby secure sleeve member 230 to cylinder 200, but yet allow removal (by cutting the silicone cement away) for later disassembly of the pole mechanism.

The stop mechanism mounted to cylinder 100 for stopping the downward movement of cylinder 150 is, as shown in FIG. 9, substantially identical to the stop mechanism just described. The stop mechanism mounted to cylinder 150 for stopping the downward movement of cylinder 200 is also similar, but differs in some respects, as will now be described.

As seen in FIG. 9, a cylindrical sleeve stop member 180 received in cylinder 150 is very similar in both shape and function to that of previously described sleeve member 230, having a first cutaway 182 to receive an O-ring 184 which is contacted by spacer 208 as cylinder 200 retracts, a second cutaway portion 186 with a shoulder 188, and a retaining ring 190 to secure member 180 from sliding downward in cylinder 150 when contacted by the downward movement of cylinder 200.

However, attached to cylindrical sleeve stop member 180 is a solid cylindrical plug member 192. Plug member 192 is secured to sleeve member 180 via bolts 195 which pass through openings 194 and are received in threaded bores 181 in sleeve member 180.

The purpose of plug member 192 is to provide a lower securement for elastomeric member 300, previously described with respect to the description of FIG. 3. A central opening 196 in plug member 192 allows swivel member 320 to pass through plug member 192, while an enlarged counterbore 197 in plug member 192, coaxial with central opening 196, receives base 322 of swivel member 320. Fluid passages 198 are then provided in plug member 192 to permit fluid to flow from cylinders 50 and 100 into the upper cylinders of the pole apparatus.

Thus, when pole apparatus 2 is fully extended elastomeric member 300 provides tension between the top of uppermost cylinder 250 and the bottom of third cylinder 150 to assist in rapid retraction of the two highest cylinders when the pole apparatus is depressurized. It will be appreciated that the reason the use of elastomeric member 300 is limited to the three uppermost cylinders is simply a materials limitation in that full extension of cylinders 150, 200, and 250 result in a stretching of elastomeric material 300 to approximately three times its normal length (which is about the limit of elasticity of any useful materials at this time), and the difficulty of fitting any useful amount of such material into the small inner diameter of the smallest tube.

Turning now to FIGS. 12–17, the preferred valve mechanism for rapidly pressurizing and depressurizing pole apparatus 2 is illustrated. A modified base member 350 is shown which receives and secures bottom cylinder 50 in similar manner to base 20, but is provided with a pair of large opposed exhaust ports **352*a* and 352*b* which are used to rapidly exhaust the fluid pressure from pole apparatus 2. Threadedly received in base 350 is an end plug 360 having a large central bore 361 and opposed exhaust ports 362*a* and 362*b* therein communicating with central bore 361 and which can be aligned with exhaust ports 352*a* and 352*b* in base 350 when end plug 360 is screwed into base 350**.

End plug 360, like end plug 24, is provided with an annular groove 26 which receives an O-ring 30 to seal end plug 360 to base 350. End plug 360 is further provided with a cutaway 30 in which is mounted (and preferably bonded to end plug 360) an O-ring 32 which provides the cushioned stop for the downward travel of cylinder 100, as previously described.

Received in a bore 366 at the top end of end plug 360 is an optional fixture 370 which enables pole apparatus 2 to be mounted via a quick release mechanism to a larger base. Fixture 370 is secured to end plug 360 via a threaded plug 372 which passes through bore 366 from the inside of end plug 360 and is received in threaded bore 371 in fixture 370. A screw 374 in plug 372 is received in a threaded bore 376 in end plug 360 to prevent rotation of plug 372 in bore 366.

Received within central bore 361 in end plug 360 is an intake valve seat member 380 having a central bore 382 therein. Valve seat member 380 is further provided with an external annular groove 381 which carries an O-ring 384 to seal valve seat member 380 in bore 361. A conical valve seat 386 is formed on one face of valve seat member 380 which faces a diaphragm 390 which may comprise a rubber or other flexible material capable of forming a seal over valve seat 386.

A cylindrical pilot valve body 400 is also mounted in bore 361 of end plug 360. O-rings 402 and 404 are respectively received in annular grooves 401 and 403 on valve body 400 to provide seals to bore 361 on both sides of exhaust passageways **362*a* and 362*b* and corresponding exhaust passageways in valve body 400** which will be described below.

Figure 13:
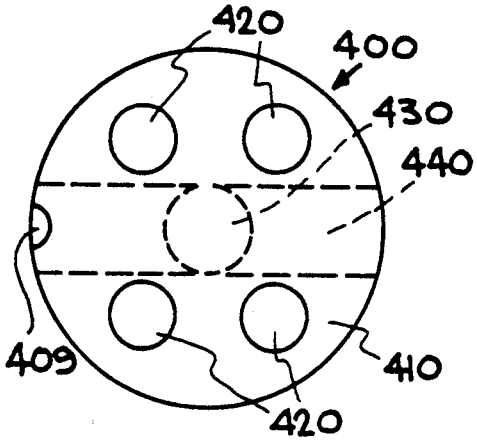
FIG. 13 is a top view of the valve shown in FIG. 12.
Figure 14:
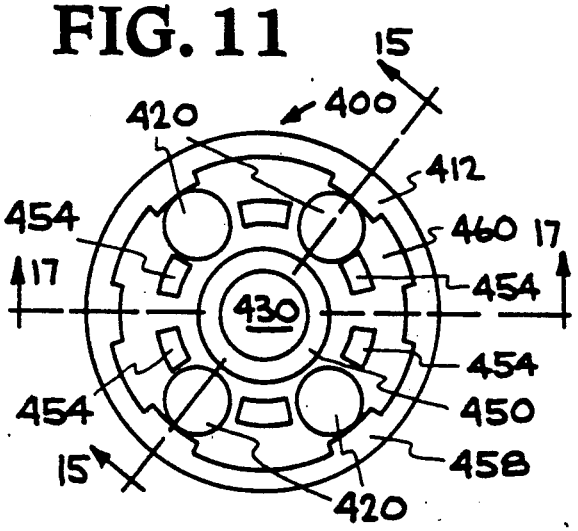
FIG. 14 is a bottom view of the valve shown in FIG. 12.
Figure 15:
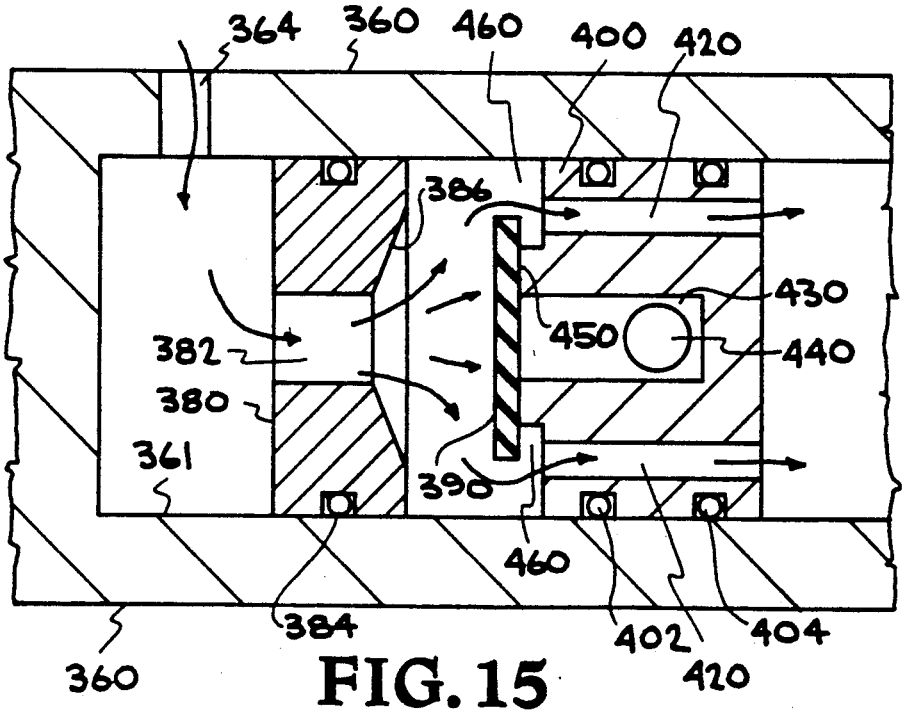
FIG. 15 is a fragmentary cross-sectional view showing the valve from FIG. 12 as sectioned along the Y—Y axis shown in FIG. 14 to illustrate the valve in an open position with fluid pressure flowing through the valve to extend the pole apparatus.
Figure 12:
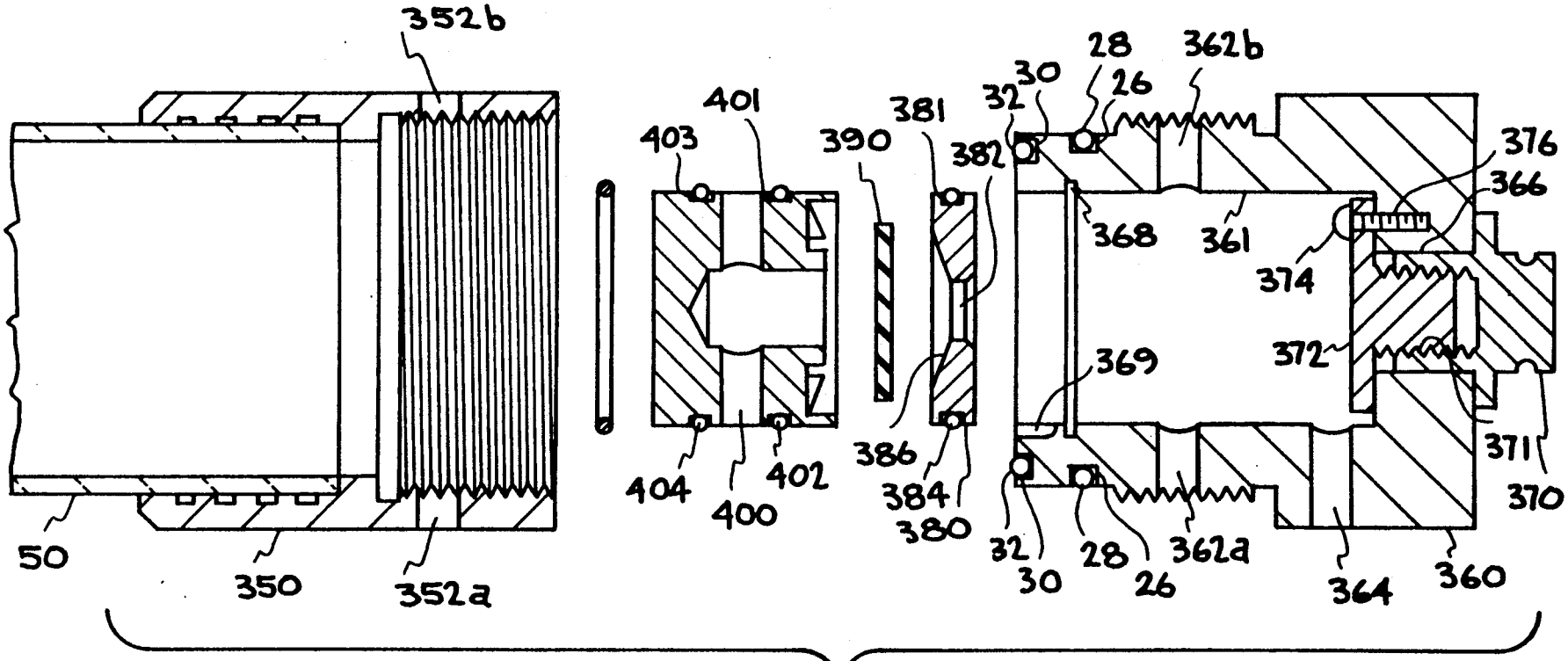
FIG. 12 is an exploded view, partially in cross-section, showing the end cap having the preferred valve structure of the invention for rapidly admitting and venting fluid to and from the pole for respectively extending and retracting the pole.
Figure 16:
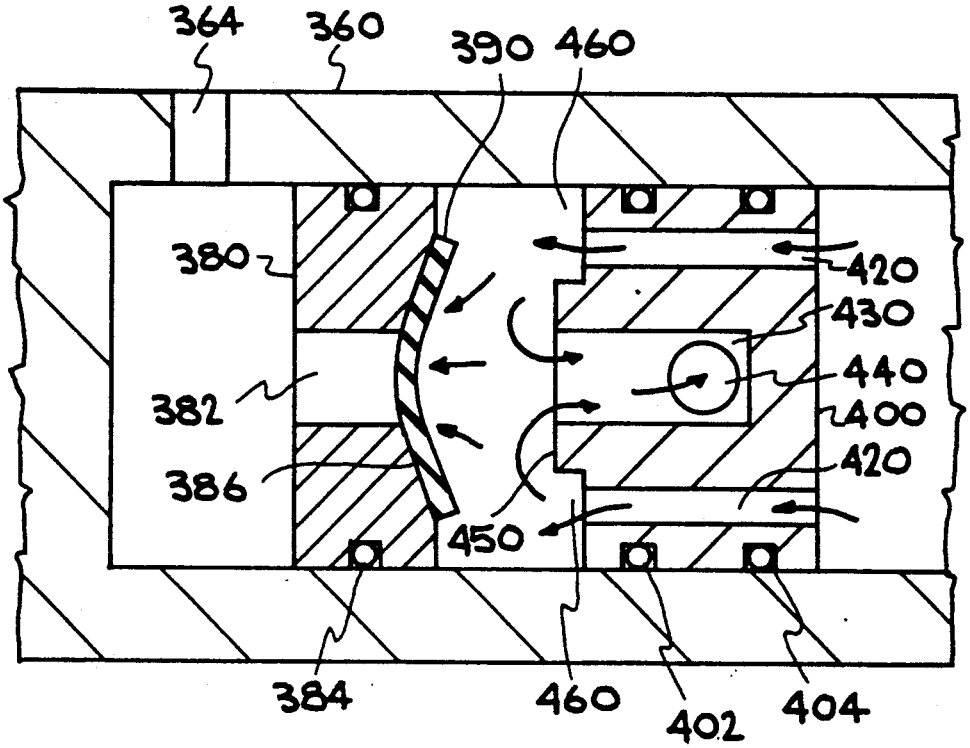
FIG. 16 is a fragmentary cross-sectional view of the same structure shown in FIG. 15, but showing the valve in a closed position with the fluid pressure flowing through the exit port of the valve to retract the pole apparatus.
Figure 17:
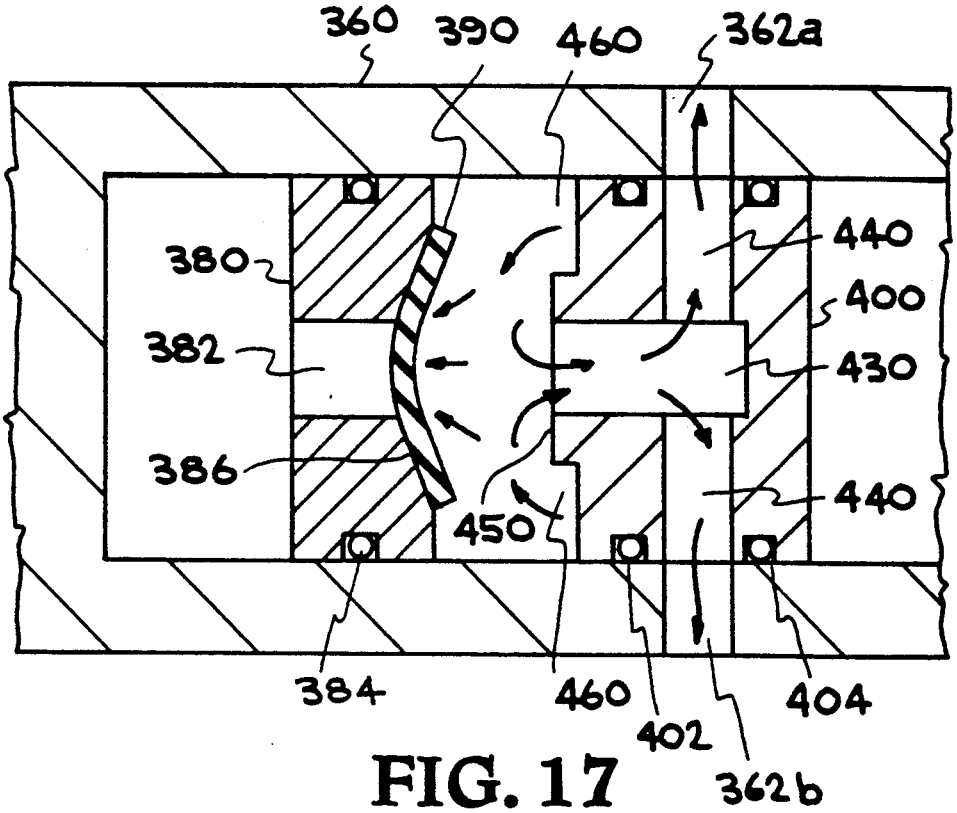
FIG. 17 is a fragmentary cross-sectional view of the same structure shown in FIG. 16, but viewed along the X—X axis shown in FIG. 14, to show the valve in a closed position with the fluid pressure flowing through the exit port of the valve and the exit port of the base to retract the pole apparatus.

As seen in FIGS. 13–16, valve body 400 is provided with inlet passageways or bores 420 which extend from one face 410 of cylindrical valve 400 to the opposite face 412. Valve body 400 is further provided with a large central exhaust bore 430 which extends into valve body 400 from face 412 and terminates about midway through valve body 400, as seen in FIGS. 15–17. Central exhaust bore 430 is perpendicularly intersected by a large bore 440 in valve body 400 which is aligned with exhaust ports or bores **362*a* and 362*b* in end plug 360. Rotational alignment of valve bore 400 in bore 361 of end plug 360 (so that bore 440 will be aligned with bores 362*a* and 362*b*) is accomplished via a key (not shown) which may be inserted in mating keyways 369 in bore 361 (as seen in FIG. 12) and 409 in valve body 440 (as seen in FIG. 13**).

Referring now in particular to FIG. 14, as well as to FIGS. 15–17, face 412 of valve body 400 is formed with a central raised surface 450 surrounding central bore 430 and raised portions 454 circularly disposed around face 412 adjacent inlet bores 420, as well as peripheral raised portions 458 of face 412. These raised portions 450, 454, and 458 define passageways 460 therebetween which, as shown in FIG. 15, permit fluid pressure to flow through inlet passageways 420 even when diaphragm 390 in a position where main exhaust bore 430 is sealed off, as shown in FIG. 15.

In operation, then, fluid pressure, such as pressurized air, is admitted from an external source, such as pressurized fluid source 10 shown in FIG. 1, through bore 364 in end plug 360 into central bore 361 where it then flows through central bore 382 in valve seat member 380 and then through passageways 460 in face 412 of valve member 400 to inlet passageways 420 through which the fluid then flows to enter the telescoping cylinders 50, 100, 150, 200, and 250 as shown in FIG. 15. It will be noted that the fluid pressure entering bore 361 of end plug 360 and then through central bore 382 of intake valve seat 380 drives diaphragm 390 away from conical valve seat 386 and against raised portion 450 of valve body 400 to thereby seal off exhaust passageway or bore 430.

However, if the inlet fluid pressure is shut off, allowing the pressure within the cylinders, and therefore in inlet passageways 420, to exceed the pressure in bore 361, diaphragm 390 will be driven away from face 412 and against conical valve seat 386 by the higher pressure in passageways 420 which will bear against the surface of diaphragm 390 facing face 412.

It should be noted in this regard, that raised portions 454 shown in FIG. 14 have been omitted from FIGS. 15–17 to avoid obscuring the portions illustrated, but these raised portions 454, also contact the surface of diaphragm 390 facing face 412 of valve body 400 to space diaphragm 390 from inlet passageways 420, but as seen in FIG. 15, the face of diaphragm 390 is directly in the path of backward flow of fluid pressure through inlet passageways 420.

Therefore, when the flow of fluid through passageways 420 reverses (because the pressure in the cylinders exceeds the incoming pressure) diaphragm 390 will be blown back onto conical valve seat 386, thereby exposing central exhaust passageway 430 through which the fluid immediately flows, as shown in FIG. 16. When the pressurized fluid flowing through central exhaust passageway 430 reaches cross bore 440, it then flows through exit ports 362*a* and 362*b*, as shown in FIG. 17, and then through mating ports 352*a* and 352*b* to the atmosphere to thereby rapidly exhaust the pressurized fluid in pole apparatus 2. Such rapid exodus of the pressurized fluid, coupled with the retracting action of stretched elastomeric member 300, result in the rapid retraction of pole apparatus 2 which characterizes the apparatus of the invention.

When pole apparatus 2 comprises five 12 foot sections of carbon filament wound epoxy cylinders, each having an approximate 1/10 inch wall thickness, with a 1¼ inch OD of the innermost cylinder and a 3½ inch OD of the outermost cylinder, the pole apparatus will weigh about 35 lbs. Such a pole apparatus will have a collapsed total length of 12 feet, 4 inches, and may be extended to a length of about 57 feet in about 7 seconds, and then retracted back to the original height in about 15 seconds. The compactness of the device, which results in its lightweight aspect, allows for a very tight nesting of the concentric tubes. The design requires only about 0.125 inches between the inner and outer walls of any two tubes, regardless of their diameter or position in the nest. That is, there is about 0.250 inches difference between the OD of one tube and the ID of the next larger tube. Thus, such a device is lightweight, compact, and portable and is, therefore, capable of being handled by a single individual.

While a specific embodiment of the pole apparatus of the invention has been illustrated and described for carrying out the construction of the pole apparatus in accordance with this invention, modifications and changes of the apparatus, parameters, materials, etc. will become apparent to those skilled in the art, and it is intended to cover in the appended claims all such modifications and changes which come within the scope of the invention.

What is claimed is:

1. A lightweight extendable and retractable telescopic pole apparatus comprising:

(a) a plurality of non-metallic telescoping cylinders comprising a largest cylinder, a smallest cylinder, and one or more intermediate cylinders, and an interior within said telescoping cylinders, with sliding and sealing surfaces between the cylinders;

(b) an end cap and a first plug member in an upper end of said smallest cylinder to thereby seal off said upper end of said smallest cylinder;

(c) a second plug member in a lower end of said largest cylinder to thereby seal off said lower end of said largest cylinder;

(d) means for admitting a fluid pressure into said largest cylinder to thereby cause said telescoping cylinders to slide relative to one another causing said pole apparatus to extend; and (e) elastomeric means connecting said end cap to a base portion in a bottom portion of one of said one or more intermediate cylinders to urge at least a portion of said plurality of cylinders back into a collapsed position when said fluid pressure in said cylinders is vented.

2. The lightweight extendable and retractable telescopic pole apparatus of claim 1 wherein annular elastomer means are provided which seal one cylinder to another when said pole apparatus is fully extended and which further serve to provide a cushion to prevent damage to said cylinders when said pole apparatus is urged back into its retractable position by said elastomeric means and said venting of said fluid pressure in said cylinders.

3. The lightweight extendable and retractable telescopic pole apparatus of claim 1 wherein valve means associated with said pole apparatus are provided to admit a fluid under pressure to the interior of said telescoping cylinders through an inlet port while pressurizing into a closed position a pressure relief port having an opening larger than said inlet port; whereby removal of said pressure on said relief port will cause said relief port to open to quickly lower the pressure in the interior of said telescoping cylinders to thereby assist in the rapid retraction of said extended pole apparatus.

4. The lightweight extendable and retractable telescopic pole apparatus of claim 3 wherein said valve means further comprise diaphragm means movable from a first position closing said pressure relief port to a second position closing said inlet port and opening said pressure relief port when said pressure in said extended cylinders exceeds the incoming pressure to thereby quickly lower the pressure in the interior of said telescoping cylinders to assist in said rapid retraction of said extended pole apparatus.

5. The lightweight extendable and retractable telescopic pole apparatus of claim 1 wherein each of said telescoping cylinders within a larger cylinder is provided, on its outer surface and adjacent a bottom of said cylinder, with seal ring means on said cylinder to provide a seal between the outer surface of said cylinder and an inner surface of said next larger cylinder.

6. The lightweight extendable and retractable telescopic pole apparatus of claim 5 wherein spacer means are further provided below and above said seal ring means to prevent said seal ring means from sliding on said outer surface of said cylinder along the axis of said cylinder.

7. The lightweight extendable and retractable telescopic pole apparatus of claim 6 wherein each of said telescoping cylinders within a larger cylinder is further provided, on its outer surface and adjacent said bottom of said cylinder, with cylindrical bearing means which bear against said inner surface of said next larger cylinder of said telescoping cylinders.

8. The lightweight extendable and retractable telescopic pole apparatus of claim 7 wherein spacer means are further provided below and above said cylindrical bearing means to prevent said cylindrical bearing means from sliding on said outer surface of said cylinder along the axis of said cylinder.

9. The lightweight extendable and retractable telescopic pole apparatus of claim 8 wherein one of said spacer means further functions as a stop means in cooperation with stop means on the next larger cylinder to stop the upward movement of said cylinder, with respect to said next larger cylinder when said pole apparatus is being extended.

10. The lightweight extendable and retractable telescopic pole apparatus of claim 9 wherein O-ring means are provided on said outer surface of said cylinder adjacent said stop means to cushion said stopping of said upward movement of said cylinder by said stop means.

11. The lightweight extendable and retractable telescopic pole apparatus of claim 9 wherein each of said telescoping cylinders surrounding a smaller cylinder is provided, on its inner surface and adjacent a top of said cylinder, with cylindrical bearing means which bear against the outer surface of said next smaller cylinder.

12. The lightweight extendable and retractable telescopic pole apparatus of claim 11 wherein spacer means are further provided below and above said cylindrical bearing means to prevent said cylindrical bearing means from sliding on said inner surface of said cylinder along the axis of said cylinder.

13. The lightweight extendable and retractable telescopic pole apparatus of claim 12 wherein one of said spacer means on said inner surface of said cylinder further comprises stop means which cooperate with said stop means and O-rings on the outer surface of said next smaller cylinder.

14. The lightweight extendable and retractable telescopic pole apparatus of claim 8 wherein one of said spacer means acts as a spacer means for both said seal ring means and said cylindrical bearing means.

15. The lightweight extendable and retractable telescopic pole apparatus of claim 1 wherein each of said telescoping cylinders within a larger cylinder is provided, on its outer surface and adjacent a bottom of said cylinder, with:

(a) first cylindrical spacer means on said cylinder and sealed to the outer surface of said cylinder adjacent said bottom of said cylinder;

(b) seal ring means on said cylinder just above said first cylindrical spacer means;

(c) second cylindrical spacer means on said cylinder just above said seal ring means and sealed to said outer surface of said cylinder, whereby said first and second cylindrical spacer means prevent said seal ring means from sliding in a direction along the axis of said cylinder;

(d) cylindrical bearing means on said cylinder just above said second cylindrical spacer means; and (e) third spacer means on said cylinder just above said bearing means and sealed to said outer surface of said cylinder, whereby said second and third cylindrical spacer means prevent said cylindrical bearing means from sliding in a direction along the axis of said cylinder;

wherein the outer diameter of each of said first, second, and third cylindrical spacer means is less than the outer diameter of said cylindrical bearing means, whereby said cylindrical bearing means will bear against the inner surface of the next larger cylinder of said telescoping cylinders.

16. The lightweight extendable and retractable telescopic pole apparatus of claim 15 wherein at least one O-ring is provided on said cylinder above said third spacer means, and each of said telescoping cylinders surrounding a smaller cylinder is provided, on an inner surface and adjacent a top of said cylinder, with:

(a) fourth cylindrical spacer means in said cylinder and sealed to an inner surface of said cylinder adjacent a top of said cylinder;

(b) second cylindrical bearing means in said cylinder just below said fourth cylindrical spacer means; and (c) fifth cylindrical spacer means in said cylinder just below said bearing means and sealed to the inner surface of said cylinder, whereby said fourth and five cylindrical spacer means prevent said second cylindrical bearing means from sliding in a direction along the axis of said cylinder;

wherein the inner diameter of each of said fourth and fifth cylindrical spacer means is less than the inner diameter of said second cylindrical bearing means, whereby said second cylindrical bearing means will bear against the outer surface of the next smaller cylinder of said telescoping cylinders, and a lower surface of said fifth spacer means will contact said at least one O-ring above said third spacer means when said telescoping cylinders are in a fully extended position.

17. The lightweight extendable and retractable telescopic pole apparatus of claim 1 wherein stop means are provided to limit the retraction of said telescoping cylinders.

18. A lightweight extendable and retractable telescopic pole apparatus comprising:

(a) a plurality of non-metallic telescoping cylinders comprising a largest cylinder, a smallest cylinder, and one or more intermediate cylinders, and an interior within said telescoping cylinders, each of said cylinders having a bottom and a top, said cylinders being further provided with sliding and sealing surfaces between the cylinders wherein each of said telescoping cylinders within a larger cylinder is provided, on its outer surface and adjacent said bottom of said cylinder, with:

(i) seal ring means; and (ii) first cylindrical bearing means; and each of said telescoping cylinders surrounding a smaller cylinder is provided, on its inner surface and adjacent said top of said cylinder, with second cylindrical bearing means;

(b) first stop means to limit the extension of said telescoping cylinders;

(c) second stop means to limit the retraction of said telescoping cylinders;

(d) an end cap and a first plug member in said top of said smallest cylinder to thereby seal off said top of said smallest cylinder;

(e) a second plug member in said bottom of said largest cylinder to thereby seal off said bottom of said largest cylinder;

(f) means for admitting a fluid pressure into said largest cylinder to thereby cause said telescoping cylinders to slide relative to one another causing said pole apparatus to extend; and (g) elastomeric means connecting said end cap with a base portion in said bottom of one of said one or more intermediate cylinders to urge at least a portion of said plurality of cylinders back into a collapsed position when said fluid pressure in said cylinders is vented.

19. The lightweight extendable and retractable telescopic pole apparatus of claim 18 wherein valve means associated with said pole apparatus are provided to admit a fluid under pressure to said interior of said telescoping cylinders through an inlet port while pressurizing into a closed position a pressure relief port having an opening larger than said inlet port, using diaphragm means movable from a first position closing said pressure relief port to a second position closing said inlet port and opening said pressure relief port when said pressure in said extended cylinders exceeds the incoming pressure, to thereby quickly lower the pressure in the interior of said telescoping cylinders to assist in said rapid retraction of said extended pole apparatus.

20. A lightweight extendable and retractable telescopic pole apparatus comprising:

(a) a plurality of non-metallic telescoping cylinders comprising a largest cylinder, a smallest cylinder, and one or more intermediate cylinders, and an interior within said telescoping cylinders, each of said cylinders having a bottom and a top, said cylinders being further provided with sliding and sealing surfaces between the cylinders wherein each of said telescoping cylinders within a larger cylinder is provided, on its outer surface and adjacent said bottom of said cylinder, with:

(i) first cylindrical spacer means on said cylinder and sealed to the outer surface of said cylinder adjacent said bottom of said cylinder;

(ii) seal ring means on said cylinder just above said first cylindrical spacer means;

(iii) second cylindrical spacer means on said cylinder just above said seal ring means and sealed to said outer surface of said cylinder, whereby said first and second cylindrical spacer means prevent said seal ring means from sliding in a direction along the axis of said cylinder;

(iv) first cylindrical bearing means on said cylinder just above said second cylindrical spacer means;

(v) third spacer means on said cylinder just above said bearing means and sealed to said outer surface of said cylinder, whereby said second and third cylindrical spacer means prevent said cylindrical bearing means from sliding in a direction along the axis of said cylinder; and (vi) at least one O-ring on said cylinder above said third spacer means;

wherein the outer diameter of each of said first, second, and third cylindrical spacer means is less than the outer diameter of said cylindrical bearing means, whereby said cylindrical bearing means will bear against an inner surface of the next larger cylinder of said telescoping cylinders; and each of said telescoping cylinders surrounding a smaller cylinder is provided, on its inner surface and adjacent said top of said cylinder, with:

(i) fourth cylindrical spacer means in said cylinder and sealed to the inner surface of said cylinder adjacent said top of said cylinder;

(ii) second cylindrical bearing means in said cylinder just below said fourth cylindrical spacer means; and (iii) fifth cylindrical spacer means in said cylinder just below said second cylindrical bearing means and sealed to the inner surface of said cylinder, whereby said fourth and five cylindrical spacer means prevent said second cylindrical bearing means from sliding in a direction along the axis of said cylinder;

wherein the inner diameter of each of said fourth and fifth cylindrical spacer means is less than the inner diameter of said second cylindrical bearing means, whereby said second cylindrical bearing means will bear against the outer surface of the next smaller cylinder of said telescoping cylinders, and a lower surface of said fifth spacer means will contact said at least one O-ring above said third spacer means when said telescoping cylinders are in a fully extended position;

(b) an end cap and a first plug member in said top of said smallest cylinder to thereby seal off said top of said smallest cylinder;

(c) a second plug member in said bottom of said largest cylinder to thereby seal off said bottom of said largest cylinder;

(d) means for admitting a fluid pressure into said largest cylinder to thereby cause said telescoping cylinders to slide relative to one another causing said pole apparatus to extend, comprising valve means associated with said pole apparatus to admit said fluid pressure to said interior of said telescoping cylinders through an inlet port while pressurizing into a closed position a pressure relief port having an opening larger than said inlet port, using diaphragm means movable from a first position closing said pressure relief port to a second position closing said inlet port and opening said pressure relief port when said pressure in said extended cylinders exceeds the incoming pressure, to thereby quickly lower the pressure in the interior of said telescoping cylinders to assist in said rapid retraction of said extended pole apparatus; and (e) elastomeric means connecting said end cap with a base portion in said bottom of one of said one or more intermediate cylinders to urge at least a potion of said plurality of cylinders back into a collapsed position when said fluid pressure in said cylinders is vented.

* * * * *